US006494400B1

(12) United States Patent
Zitella et al.

(10) Patent No.: US 6,494,400 B1
(45) Date of Patent: Dec. 17, 2002

(54) AUTOMATIC FILM ROLL CHANGER AND METHOD OF OPERATING THE SAME

(75) Inventors: Marco Zitella, Montreal (CA); Faruk M. Turfan, Brossard (CA)

(73) Assignee: Illinois Tool Works Inc., Glenview, IL (US)

( * ) Notice: Subject to any disclaimer, the term of this patent is extended or adjusted under 35 U.S.C. 154(b) by 225 days.

(21) Appl. No.: 09/696,505

(22) Filed: Oct. 25, 2000

(51) Int. Cl.[7] ..... B65H 67/02
(52) U.S. Cl. ..... 242/559.3; 414/736
(58) Field of Search ..... 242/559, 559.3, 242/559.4, 559.1; 414/911, 736

(56) References Cited

U.S. PATENT DOCUMENTS 4,416,577 A * 11/1983 Inaba et al. ..... 414/736
4,505,636 A * 3/1985 Sugino et al. ..... 414/736
4,997,336 A * 3/1991 Galbani ..... 414/911
5,135,103 A * 8/1992 Focke et al. ..... 414/911
5,205,505 A * 4/1993 Focke et al. ..... 242/559.3
5,226,778 A * 7/1993 Sekitani ..... 414/911
5,249,757 A * 10/1993 Draghetti et al. ..... 242/559.1
5,332,351 A * 7/1994 Nelson et al. ..... 414/911
5,533,859 A * 7/1996 McHenry ..... 414/911
6,076,763 A * 6/2000 Spatafora ..... 242/559.1

* cited by examiner

*Primary Examiner*—William A. Rivera
(74) *Attorney, Agent, or Firm*—Donald J. Breh; Mark W. Croll; Lisa M. Soltis

(57) ABSTRACT

A new or fresh plastic film roll/depleted or exhausted plastic film roll tube or core exchange system comprises a plastic film roll dispenser mounting framework, a plastic film roll magazine assembly, and a new or fresh plastic film roll/depleted or exhausted plastic film roll tube or core exchange assembly. A supply of new or fresh plastic film rolls are serially mounted upon the new or fresh plastic film roll supply magazine, and the new or fresh plastic film roll/spent or exhausted plastic film roll core or tube exchange mechanism is utilized to remove a spent or exhausted plastic film roll core or tube from the plastic film roll dispenser mounting framework, remove a new or fresh plastic film roll from the supply magazine, and mount the new or fresh plastic film roll upon the plastic film roll dispenser mounting framework while the spent or exhausted plastic film roll core or tube is mounted upon the supply magazine.

20 Claims, 7 Drawing Sheets

AUTOMATIC FILM ROLL CHANGER AND METHOD OF OPERATING THE SAME

FIELD OF THE INVENTION

The present invention relates generally to a plastic film roll dispensing system and a method of operating the same, and more particularly to a new and improved system and method for automatically exchanging film roll components wherein a spent or exhausted film roll tube or core is initially removed from a film roll dispenser mounting framework, a new or fresh plastic film roll is subsequently removed from a slidable magazine upon which a plurality of new or fresh film rolls are removably mounted, and lastly, the new or fresh plastic film roll removed from the slidable magazine is subsequently mounted upon the film roll dispenser mounting framework in preparation for subsequent plastic film wrapping operations.

BACKGROUND OF THE INVENTION

Plastic film roll dispensing mechanisms, wherein, for example, plastic film is dispensed from a plastic film roll during plastic film wrapping operations performed upon palletized loads, are of course well-known. Obviously, the plastic film dispensing rolls require periodic replacement when, for example, the plastic film supply disposed upon a particular plastic film roll is spent or exhausted. Accordingly, systems have been developed and implemented wherein plastic film roll components can effectively be exchanged as a result of which, for example, a spent or exhausted plastic film roll tube or core can be removed from its film roll dispenser mounting framework and subsequently, a new or fresh plastic film roll can be mounted upon the film roll dispenser mounting framework.

Conventional plastic film roll exchange systems, however, have not proven entirely satisfactory from the viewpoint that when, for example, a spent or exhausted plastic film roll tube or core is to be removed from its dispenser mounting framework and a fresh or new plastic film roll is to be mounted upon the dispenser mounting framework so as to replace the removed spent or exhausted plastic film roll tube or core, operator personnel are required to place a new or fresh plastic film roll at a particular position upon the plastic film roll exchange apparatus or equipment each time a spent or exhausted plastic film roll tube or core is to be replaced by means of a fresh or new plastic film roll. This type of plastic film roll exchange operation, however, is not only very time consuming and tedious from a manpower requirement point of view, but in addition, is in effect a wasteful operation in that in lieu of the operator personnel placing a new or fresh plastic roll of film upon the plastic film roll exchange apparatus or equipment, the operator personnel could just simply place the new or fresh plastic roll of film directly upon the plastic film roll dispenser mounting framework of the overall or combination plastic film roll dispensing apparatus or machinery. In other words, such conventional plastic film roll exchange apparatus or equipment does not in fact render the plastic film roll exchange operations truly automatic, such apparatus or equipment does not actually eliminate or substantially reduce the need for operator personnel, such apparatus or equipment does not substantially reduce the amount of work required to be performed by means of such operator personnel, and such apparatus or equipment does not substantially reduce the amount of time that such operator personnel are required to devote to attending the apparatus or equipment during performance of the various plastic film wrapping operations.

A need therefore exists in the art for a new and improved plastic film roll exchange system, and a method of operating the same, which will, in effect, render the plastic film roll core or tube and the fresh or new plastic film roll exchange operation entirely automatic whereby operator personnel need not actually be required to continuously attend or assist the operation of the system other than to possibly periodically monitor the system or service the same should, for example, an operational malfunction happen to occur.

OBJECTS OF THE INVENTION

Accordingly, it is an object of the present invention to provide a new and improved plastic film roll exchange system, and a method of operating the same, which can automatically replace an exhausted or spent plastic film roll tube or core with a fresh or new plastic film roll.

Another object of the present invention is to provide a new and improved plastic film roll exchange system, and a method of operating the same, which can automatically replace an exhausted or spent plastic film roll tube or core with a fresh or new plastic film roll so as to effectively overcome the various operational disadvantages or drawbacks characteristic of the PRIOR ART plastic film roll exchange systems or apparatus.

An additional object of the present invention is to provide a new and improved plastic film roll exchange system, and a method of operating the same, which automatically replaces an exhausted or spent plastic film roll tube or core with a fresh or new plastic film roll by automatically removing the spent or exhausted plastic film roll tube or core from its dispenser mounting framework and mounting the fresh or new plastic film roll upon the dispenser mounting framework.

A further object of the present invention is to provide a new and improved plastic film roll exchange system, and a method of operating the same, which automatically replaces an exhausted or spent plastic film roll tube or core with a fresh or new plastic film roll by automatically removing the spent or exhausted plastic film roll tube or core from a dispenser mounting framework, removing a fresh or new plastic film roll from a plastic film roll magazine upon which a plurality of plastic film rolls are mounted, and mounting the fresh or new plastic film roll upon the dispenser mounting framework without requiring operator personnel to attend the apparatus or equipment comprising the system or to assist its operation during the exchange process.

SUMMARY OF THE INVENTION

The foregoing and other objectives are achieved in accordance with the teachings and principles of the present invention through the provision of a new and improved plastic film roll exchange system, and a method of operating the same, which comprises three major operating components. The first major operating component of the system comprises a plastic film roll dispenser mounting framework upon which a plastic film roll is mounted for dispensing plastic film during, for example, a palletized load plastic film wrapping operation. The second major operating component of the system comprises a plastic film roll magazine which is laterally spaced from the plastic film roll dispenser mounting framework and which is adapted to movably mount a plurality of new or fresh plastic film rolls thereon, while in addition, the plastic film roll magazine is also adapted to receive spent or exhausted plastic film roll tubes or cores removed from the plastic film roll dispenser mounting framework. The third major operating component of the system comprises an exchange mechanism which is interposed between the plastic film roll dispenser mounting framework and the plastic film roll magazine and is adapted to be movable in both translational and rotational modes so as to remove a spent or exhaust plastic film roll tube or core from the plastic film roll dispenser mounting framework, so as to remove a new or fresh plastic film roll from the plastic film roll magazine, and to perform an exchange operation wherein a new or fresh plastic film roll is exchanged for a spent or exhausted plastic film roll tube or core whereby the new or fresh plastic film roll will be mounted upon the plastic film roll dispenser mounting framework while the previously removed spent or exhausted plastic film roll tube or core will be mounted upon the plastic film roll magazine. The system is then readied for a new plastic film roll exchange operation when the same is required upon the depletion or exhaustion of the new or fresh plastic film roll deposited and now disposed upon the plastic film roll dispenser mounting framework.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
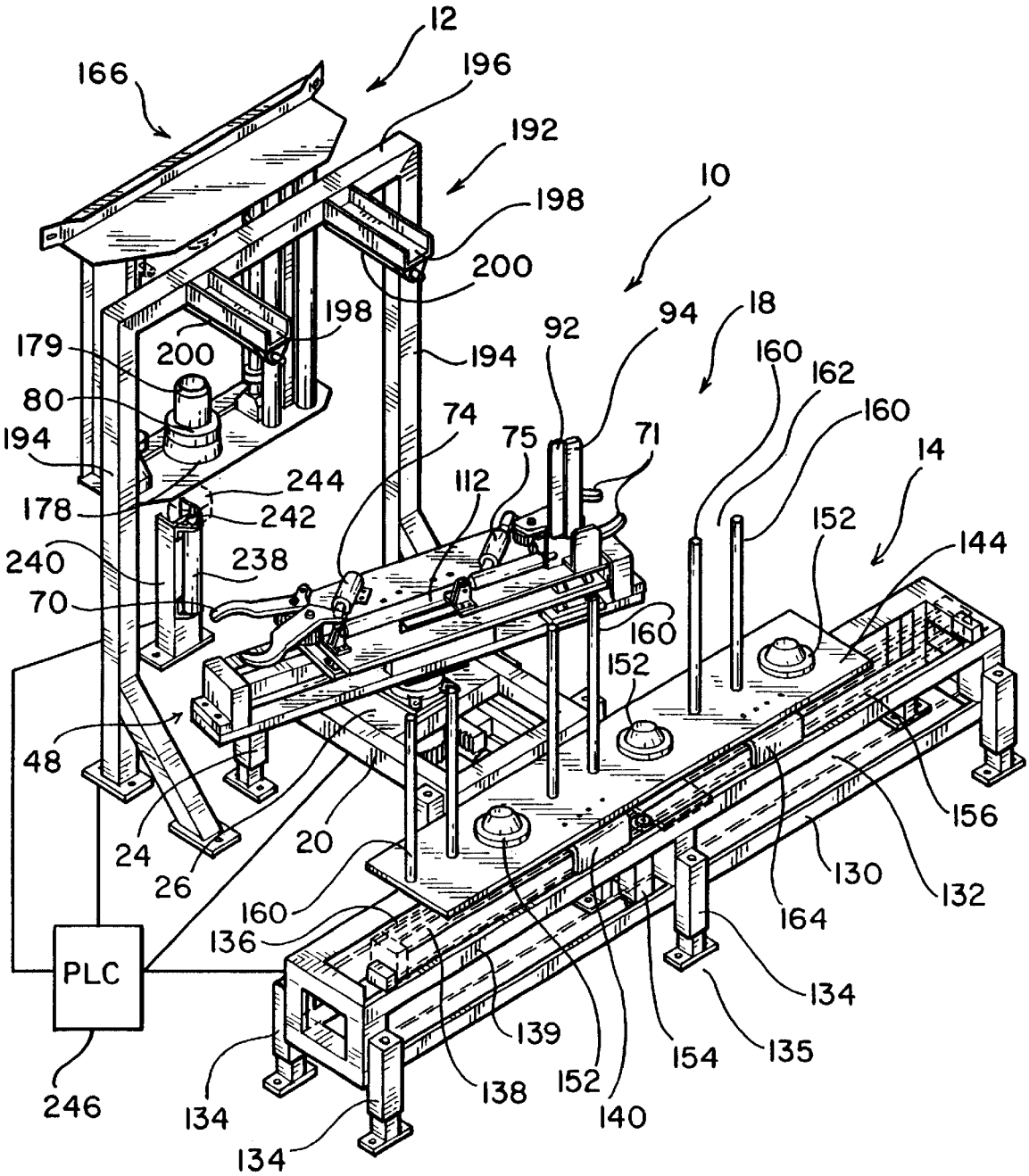
FIG. 1 is a perspective view of the new and improved automatic plastic film roll exchange system which has been developed and constructed in accordance with the teachings and principles of the present invention and showing the cooperative parts thereof.
Figure 2:
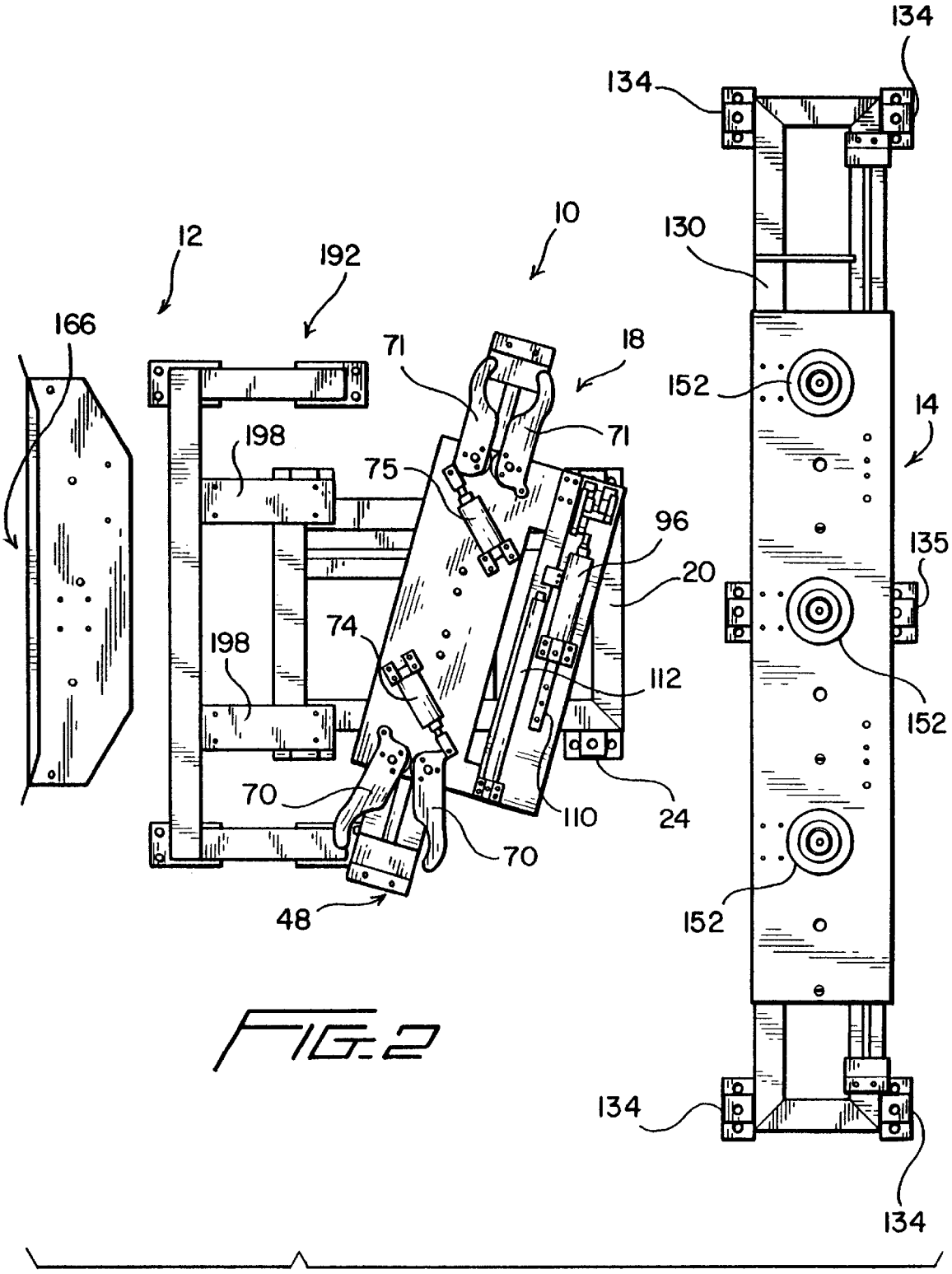
FIG. 2 is a top plan view of the new and improved automatic plastic film roll exchange system as disclosed in FIG. 1.
Figure 3:
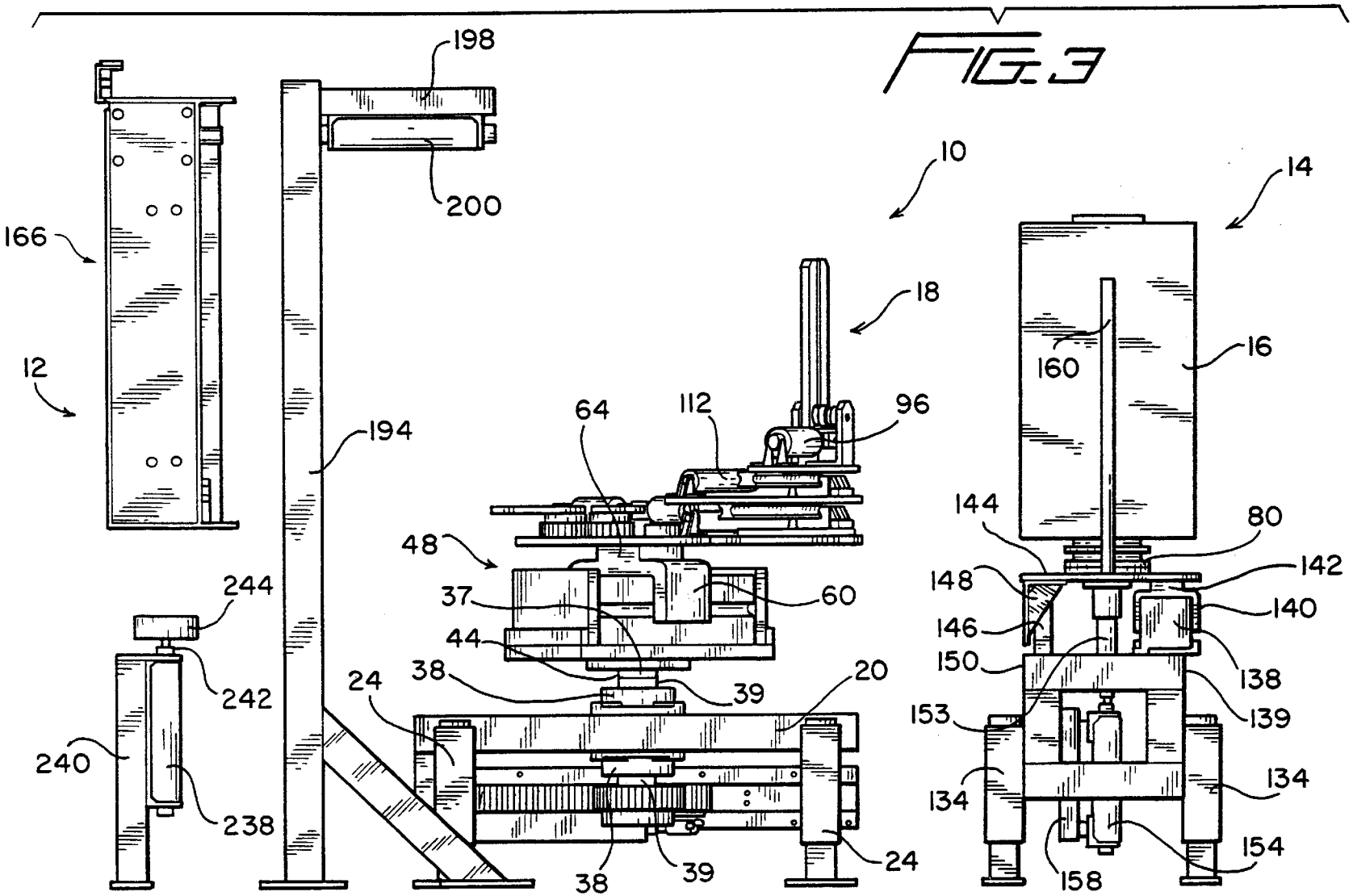
FIG. 3 is a side elevational view of the new and improved automatic plastic film roll exchange system as disclosed in FIGS. 1 and 2.

Referring now to the drawings, and more particularly to FIGS. 1–3 thereof, the new and improved automatic plastic film roll exchange system, which has been developed and constructed in accordance with the teachings and principles of the present invention, is disclosed and is generally indicated by the reference character 10. In accordance with the principles and teachings of the present invention, the system 10 is seen to comprise three essential operative components.

More particularly, a first one of the three essential components of the automatic plastic film roll exchange system 10 comprises a plastic film roll dispenser mounting framework 12 upon which a plastic film roll is to be mounted such that the plastic film disposed upon the plastic film roll can be dispensed during, for example, a palletized load plastic film wrapping operation. A second one of the three essential components of the automatic plastic film roll exchange system 10 comprises a plastic film roll supply magazine assembly 14 upon which a plurality of new or fresh plastic film rolls, one of which is shown at 16 in FIG. 3, are disposed for individual disposition upon the plastic film roll dispenser mounting framework 12 when the supply of plastic film disposed upon a particular plastic film roll previously mounted upon the plastic film roll dispenser mounting framework 12 has been exhausted. In addition, the plastic film roll supply magazine assembly 14 is also adapted to mount thereon tubes or cores of spent or exhausted plastic film rolls when particular plastic film rolls have been spent or exhausted and the tubes or cores of the spent or exhausted plastic film rolls have been removed from the plastic film roll dispenser mounting framework 12 in preparation for an exchange operation whereby individual tubes or cores of spent or exhausted plastic film rolls are to be replaced by means of a new or fresh plastic film roll 16 disposed upon the plastic film roll supply magazine assembly 14.

Lastly, the third one of the three essential components of the automatic plastic film roll exchange system 10 comprises a new or fresh plastic film roll/spent or exhausted plastic film roll core or tube exchange assembly 18 which is adapted to undergo both linear or translational as well as rotational movements during an exchange or replacement operation so as to actually achieve the exchange or replacement of a core or tube of a spent or exhausted plastic film roll with, or by means of, a new or fresh plastic film roll 16 as will be more fully described hereinafter. With reference being additionally made to FIGS. 4–6 such that reference is therefore being made to FIGS. 1–6, the new or fresh plastic film roll/spent or exhausted plastic film roll core or tube exchange assembly 18 is seen to comprise a substantially planar, four-sided frame member 20 which has a substantially rectangular configuration and which encloses an interior space 22. The frame member 20 is fixedly welded to upper end portions of a plurality of upstanding posts or standards 24 which are respectively located adjacent each one of the corner regions of the frame member 20, and a central platform 26, in turn, has opposite sides thereof fixedly welded to interior surface portions of oppositely disposed, longitudinally extending long side members of the rectangular frame member 20. As will be more fully appreciated hereinafter, the central platform 26 is provided for mounting thereon the rotary or rotational driving system for the exchange assembly 18.

More particularly, a hollow, longitudinally extending structural beam 28 is fixedly secured to interior surface portions of one pair of the upstanding standards or posts 24 which are disposed along one of the longitudinally extending long sides of the frame member 20, and a pair of upper and lower longitudinally extending channel members 30 are fixedly secured to a backing plate 31 which in turn is fixedly secured to the structural beam 28. The upper and lower channel members 30,30 therefore together define a longitudinally extending track portion 33, and a longitudinally extending rack member 32 has a mounting portion 34 thereof movably disposed within the channel track portion 33, while a pinion member 36 is enmeshed with the rack member 32. The pinion member 36 is operatively fixed upon an upstanding shaft 37 through means of a keyed connection, not shown, and the upstanding shaft 37 is operatively associated with a rotary bearing assembly which, as may best be seen in FIG. 5, comprises an external housing 38, which is fixedly mounted upon the central platform 26, and an internal rotary bearing member 39 within which the upstanding shaft 37 is press fitted. Consequently, when the rack member 32 is moved longitudinally within the track portion 33 of the channel members 30, 30, the pinion member 36 is caused to rotate so as to in turn cause rotational movement of the upstanding shaft 37 within the rotary bearing member 39. In conjunction with the aforenoted structural arrangement, and as may also be best seen from FIG. 5, a mounting plate 40 is adapted to be fixedly secured to the frame member 20, and a pneumatic piston-cylinder assembly 42 has a first end portion thereof fixedly connected to the mounting plate 40 while a second opposite piston rod end portion of the assembly 42 is operatively connected to the rack member 32.

Accordingly, activation of the piston-cylinder assembly 42 causes longitudinal linear movement of the rack member 32 within the longitudinally extending track portion 33 of the channel members 30, 30 whereby the longitudinal linear movement of the rack member 32 in turn causes rotational movement of the pinion member 36 and the upstanding shaft 37 within the rotary bearing member 39. The upper end portion of the upstanding shaft 37 has a shoulder portion 44 by means of which the upper end portion of the upstanding shaft 37 is seated upon the upper end of the rotary bearing member 39, and the upper end portion of the upstanding shaft 37 is fixedly welded to a mounting plate 46. The mounting plate 46 is adapted to be operatively connected to the bottom or undersurface portion of a pneumatic band cylinder assembly 48. Pneumatic band cylinder assemblies are well known in the art and will therefore not be described in detail, however, for the purposes of this disclosure, suffice it to say that the pneumatic band cylinder assembly 48, as best seen or appreciated from FIGS. 1 and 3–6, is mounted atop a base plate 50 which is fixedly secured to the mounting plate 46 which is welded to the upper end portion of the upstanding shaft 37. Accordingly, rotation of the pinion 36 causes rotation of the upstanding shaft 37 which, in turn, causes rotation of the mounting plate 46, base plate 50, and pneumatic band cylinder assembly 48.

Figure 5:
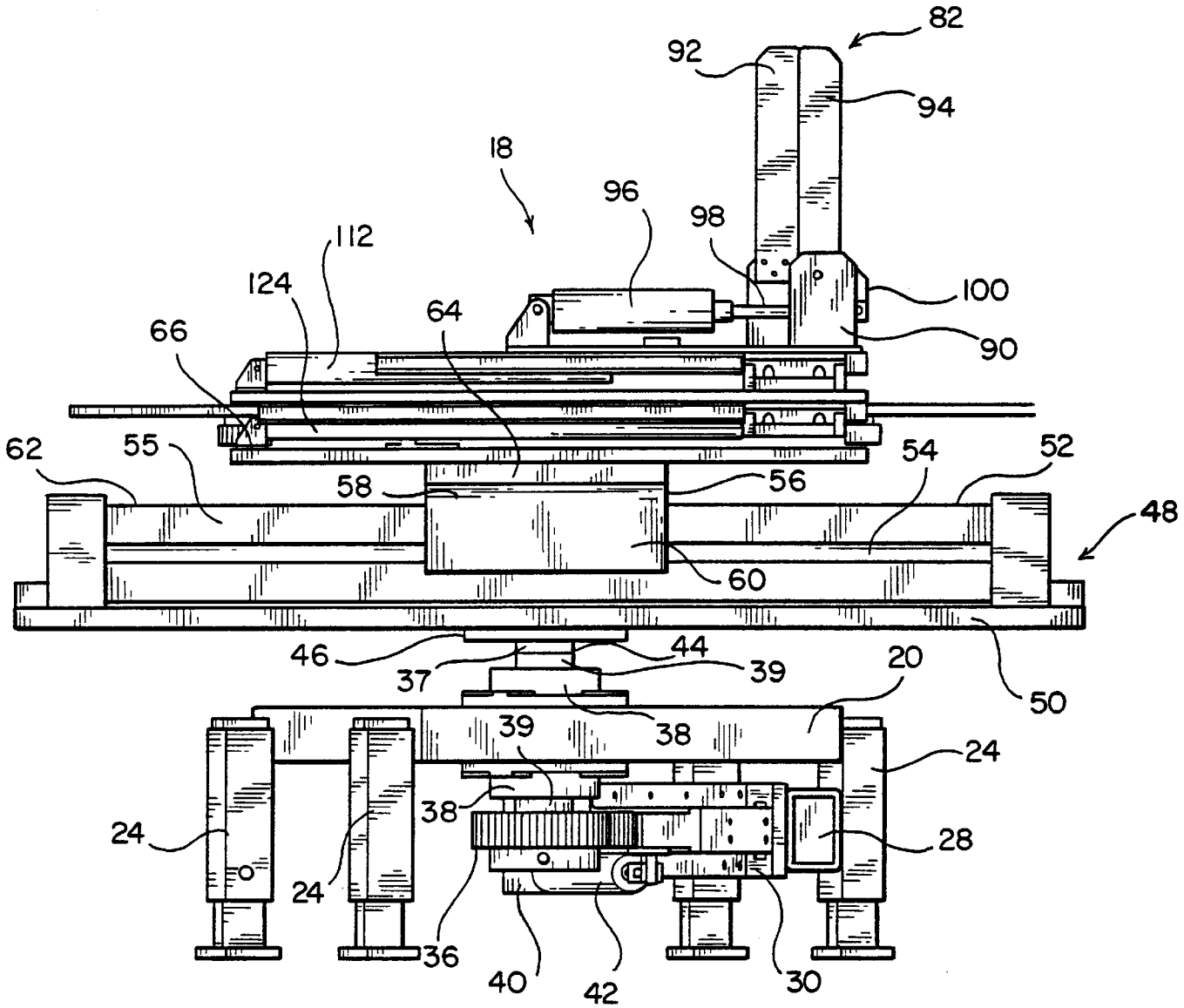
FIG. 5 is a side elevational view of the translational and rotational exchange mechanism component of the new and improved automated plastic film roll exchange system as disclosed within FIG. 4.
Figure 8:
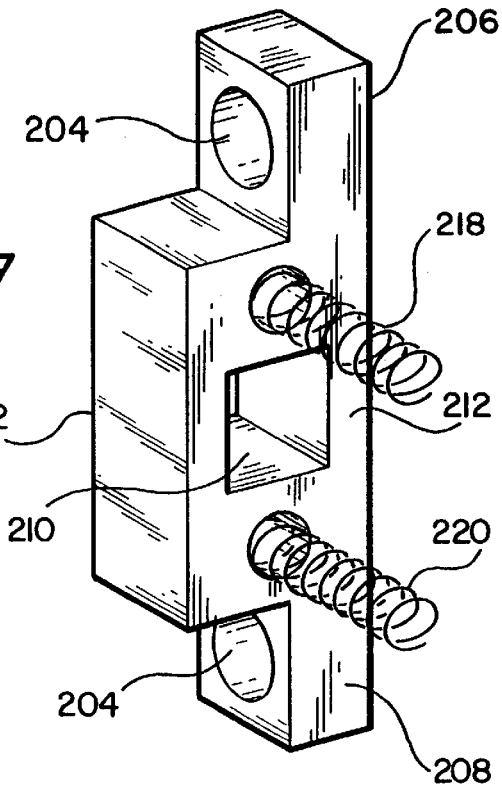
FIG. 8 is a perspective view of a mounting bracket used in conjunction with the latching mechanism employed in connection with the plastic film roll dispenser mounting framework.

The band cylinder assembly 48 comprises a band cylinder component or housing 52 which has a configuration that substantially comprises a rectangular parallelepiped. Longitudinal guide slots or channels 54, only one of which is shown in FIGS. 3 and 5, are provided within opposite longitudinal side walls 55 of the band cylinder component or housing 52, and a slide member 56, which is fixedly connected to a piston member, not shown, disposed internally within the band cylinder component or housing 52, is adapted to be longitudinally movable along the band cylinder component or housing 52 in response to pneumatic driving air acting upon a particular side of the band cylinder piston, not shown, in a well-known manner. As can best be seen from FIGS. 3 and 6, the slide member 56 has a substantially inverted U-shaped cross-sectional configuration as defined, for example, by means of an upper, horizontally disposed base portion or top wall 58, and a pair of dependent side walls 60, 60. The undersurface portion of the slide member top wall 58 is adapted to be slidably disposed atop the upper or top wall portion 62 of the band cylinder component or housing 52, while the lower end portion of each dependent side wall 60 of the slide member 56 is provided with an inwardly disposed flange or rib, not shown, which is adapted to be slidably engaged within its respective or associated guide channel or slot 54 provided within each side wall 55 of the band cylinder component or housing 52. In this manner, the slide member 56 is properly guided throughout its longitudinal movements upon or with respect to the band cylinder component or housing 52. As best seen from FIGS. 3 and 6, the slide member base portion or top wall 58 is provided with an axially located, longitudinally extending, upstanding pedestal member 64, and a primary slide plate 66, which forms or defines the main transfer component of the new or fresh plastic film roll/spent or exhausted plastic film roll core or tube exchange assembly 18, has its lower or undersurface portion thereof affixed to and supported upon the upper surface portion of the pedestal member 64.

Figure 4:
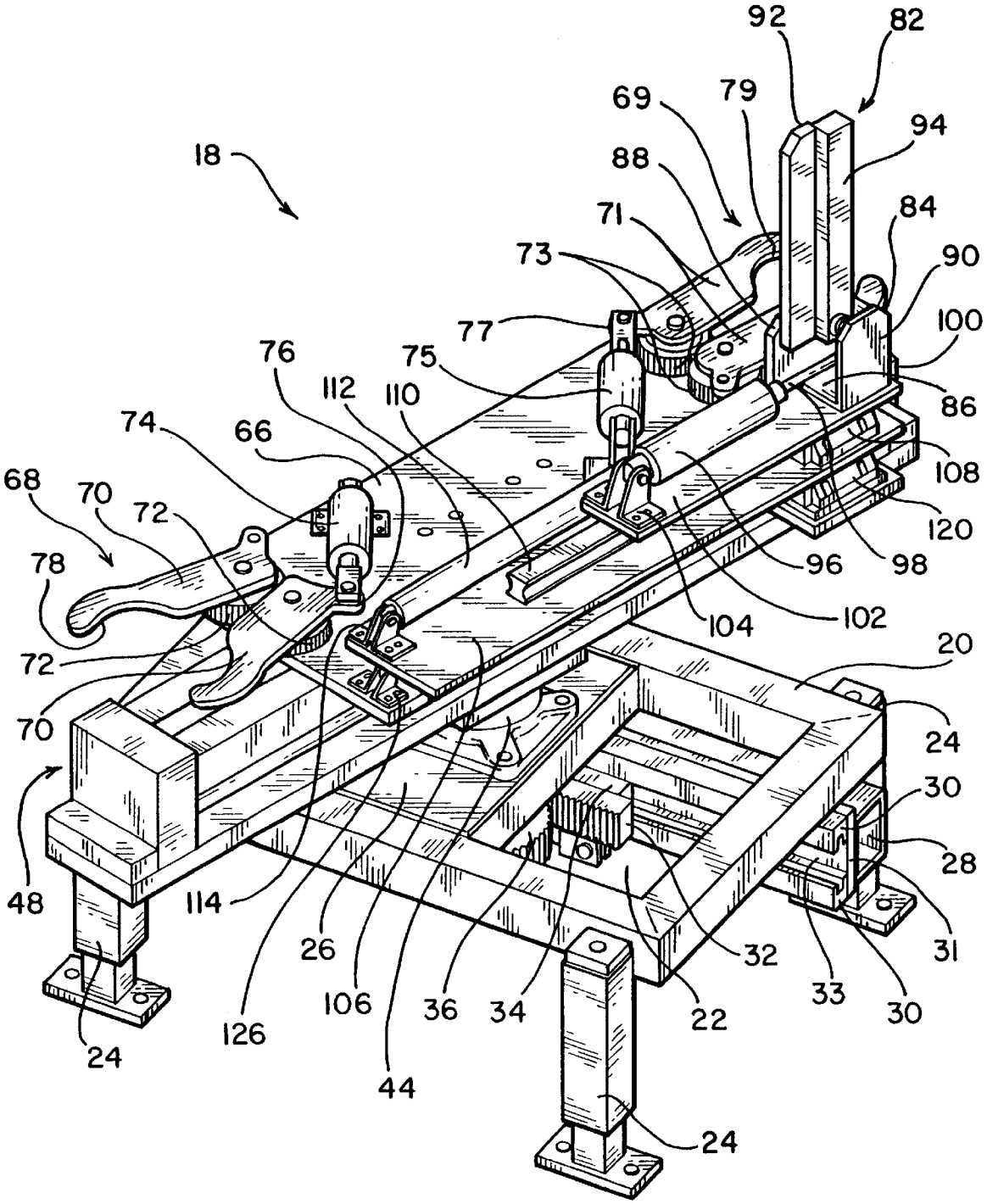
FIG. 4 is a perspective view of the translational and rotational exchange mechanism component of the new and improved automated plastic film roll exchange system as disclosed within FIGS. 1 and 2.

With reference therefore still being made to FIGS. 1–6, and with particular reference being made to FIGS. 2 and 4, the new or fresh plastic film roll/spent or exhausted plastic film roll core or tube exchange assembly 18 is seen to further comprise in more detail two sets of grab mechanisms 68, 69 respectively mounted upon opposite ends of the primary slide plate 66, wherein each set of grab mechanisms 68, 69 comprises a cooperative pair of grab members or pincers 70, 70 and 71, 71. A first end portion of each grab member or pincer 70 is fixedly mounted upon a gear member 72, and each grab member or pincer 71 is likewise mounted upon a gear member 73. The gear members 72, 73 are rotatably mounted upon opposite ends of the primary slide plate 66 so as to define two sets of gear members 72, 72 and 73, 73 wherein the gear members 72, 72 and 73, 73 of each set of gear members disposed at each end of the primary slide plate 66 are enmeshed with each other.

A pneumatic piston-cylinder assembly 74, 75 is respectively operatively connected to an ear portion 76, 77 of one of the grab mechanisms or pincers 70, 71 of each set of grab mechanisms 68, 69, and in this manner, when the piston cylinder assemblies 74, 75 are activated such that the piston rods thereof are appropriately extended or retracted, the grab mechanisms or pincers 70, 70 and 71, 71 are moved in pivotal modes toward or away from each other, as a result of the enmeshed engagement of the gear members 72, 72 and 73, 73, so as to define therebetween relatively opened or closed positions. The free end portion 78 of each grab mechanism or pincer 70, and the free end portion 79 of each grab mechanism or pincer 71, has a substantially arcuate configuration such that together, the arcuate portions 78, 78 and 79, 79 of the grab mechanisms or pincers 70, 70 and 71, 71 in effect define a substantially circular engagement surface which can in effect encircle and engage a flanged collar portion 80 of an insert which is adapted to be fixedly disposed within the lower end portion of each plastic film roll core or tube and which is best shown in FIG. 3. In this manner, as will be described more fully hereinafter, the grab mechanisms or pincers 70, 70 and 71, 71 can respectively remove a new or fresh plastic film roll 16 from the supply magazine 14, remove a tube or core of a spent or exhausted plastic film roll from the dispenser mounting framework 12, or transport a new or fresh plastic film roll 16, or a tube or core of a spent or exhausted plastic film roll, during a new or fresh plastic film roll/spent or exhausted plastic film roll tube or core exchange operation.

A film end or tail clamp mechanism 82 is also provided upon one end of the primary slide plate 66 so as to be, for example, disposed adjacent to the grab members or pincers 71, 71, and it is seen from FIGS. 4 and 5 that the film end or tail clamp mechanism 82 comprises a clevis member 84 which has a substantially U-shaped cross-sectional configuration as defined by means of a base member 86 and a pair of laterally spaced upstanding side walls 88, 90. A first upstanding clamp member 92 is fixedly mounted upon the clevis side wall 88, while a second clamp member 94 is pivotally mounted upon the upstanding side walls 88, 90 such that the pivotal clamp member 94 is movable between a first horizontally disposed position, not illustrated, and a second vertical position, as illustrated, for example, within FIGS. 1, 4, and 5, at which position the second movable clamp member 94 cooperates with the first fixed clamp member 92 so as to retain the end or tail portion of a new or fresh plastic film roll therebetween in preparation for transfer of the end or tail portion of the new or fresh plastic film roll from the new or fresh plastic film roll, once the same is mounted upon the plastic film roll dispenser mounting framework 12, to, for example, a plastic film palletized load wrapping machine, not shown, in connection with which the plastic film roll exchange system of the present invention is to be used. In order to move the second pivotal clamp member 94 between the aforenoted first and second horizontal and vertical positions, a pneumatic piston-cylinder assembly 96 is provided wherein the piston rod 98 of the piston-cylinder assembly 96 is operatively connected to an ear portion 100 of the pivotal clamp member 94. Accordingly, when the piston rod 98 of the piston-cylinder assembly 96 is extended, as illustrated, the pivotal clamp member 94 is pivotally moved to its vertical position, whereas when the piston rod 98 is retracted, the pivotal clamp member 94 will be pivoted from its illustrated vertical position to its horizontal position in preparation for engaging the end or tail portion of the new or fresh plastic film roll 16 disposed upon the plastic film roll magazine 14. It is noted that in order to properly transfer the film end or tail of the new or fresh plastic film roll 16 to the plastic film palletized load wrapping machine, not shown, as noted hereinbefore, the entire film end or tail clamp mechanism 82 must be moved translationally forward a predetermined amount.

Figure 6:
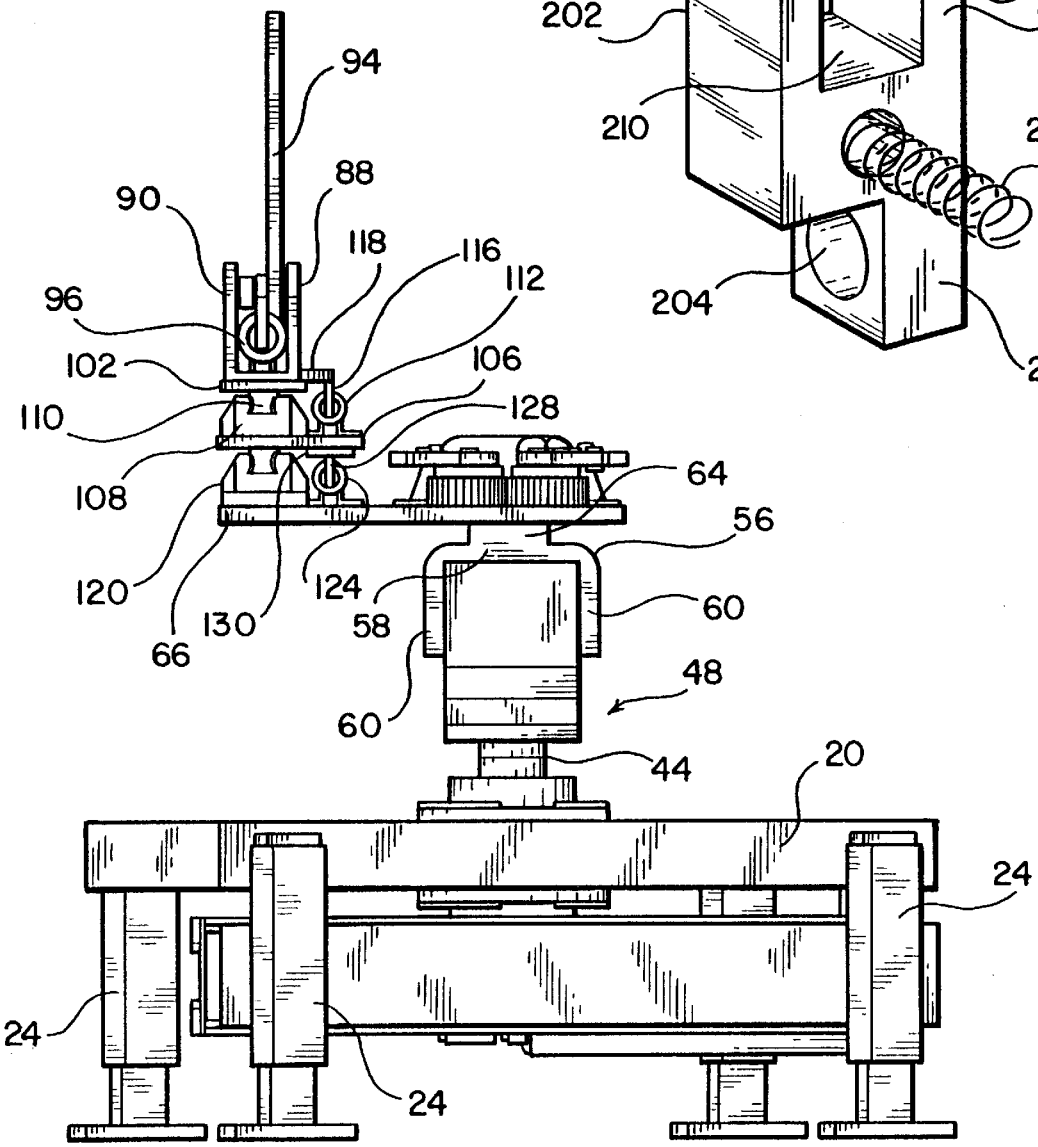
FIG. 6 is an end elevational view of the translational and rotational exchange mechanism component of the new and improved automated plastic film roll exchange system as disclosed within FIGS. 4 and 5.

In order to achieve such movement, it is seen that the cylinder end of the piston-cylinder assembly 96 is fixedly mounted upon one end of a first horizontally movable auxiliary slide plate 102 by means of a bracket 104, while the clevis member 84 is mounted upon a second opposite end of the first auxiliary slide plate 102. A second horizontally movable auxiliary slide plate 106 is disposed beneath the first auxiliary slide plate 102, and in order to provide for the relative sliding movement of the first upper auxiliary slide plate 102 with respect to the second lower auxiliary slide plate 106, a first slide bearing 108 is fixedly mounted upon one end of the second auxiliary slide plate 106 while a first slide rail 110, fixedly mounted upon the undersurface of the first auxiliary slide plate 102, is adapted to be slidably guided for longitudinal movement within the first slide bearing 108. A second piston-cylinder assembly 112 has its cylinder end fixedly mounted upon the second lower auxiliary slide plate 106 by means of a bracket member 114 while its piston rod 116, as best seen in FIG. 6, is operatively connected to the first upper auxiliary slide plate 102 through means of a laterally extending link or rod member 118. In this manner, extension or retraction of the piston rod 116 of the second piston-cylinder assembly 112 causes horizontal movement of the first upper auxiliary slide plate 102 with respect to the second lower auxiliary slide plate 106.

In a similar manner, in order to provide for the relative sliding movement of the second lower auxiliary slide plate 106 with respect to the primary slide plate 66, a second slide bearing 120 is fixedly mounted upon one end of the primary slide plate 66 while a second slide rail 122, shown in FIG. 6, is fixedly mounted upon the undersurface of the second lower auxiliary slide plate 106 so as to be slidably guided for longitudinal movement within the second slide bearing 120. A third piston-cylinder assembly 124, as best seen in FIG. 6, has its cylinder end fixedly mounted upon the primary slide plate 66 by means of a bracket member 126 while its piston rod 128, as also best seen in FIG. 6, is operatively connected to the second lower auxiliary slide plate 106 through means of a bracket member 130. In this manner, extension or retraction of the piston rod 128 of the piston-cylinder assembly 124 causes horizontal movement of the second lower auxiliary slide plate 106 with respect to the primary slide plate 66, and such movement of the second lower slide plate 106 may obviously be combined with similar longitudinal movement of the first upper slide plate 102 as has been previously discussed in order to in fact achieve the desired longitudinal movement and disposition of the film end or tail clamp mechanism 82 so as to in turn properly position the plastic film roll end or tail portion, clampingly secured within the film end or tail clamp mechanism 82, with respect to the plastic film wrapping machinery in preparation for the performance of a palletized load wrapping operation.

With reference now being made to FIGS. 1–3, the structure of the plastic film roll supply magazine assembly 14 will now be described in detail. More particularly, it is seen that in a manner similar to that of the new or fresh plastic film roll/spent or exhausted plastic film roll core or tube exchange assembly 18, the plastic film roll supply magazine assembly 14 comprises a four-sided framework 130 which has a configuration which is substantially that of a rectangular parallelepiped and which encloses an interior space 132. The framework 130 is fixedly welded to substantially upper end portions of a plurality of upstanding posts or standards 134 which are respectively located adjacent each one of the corner regions of the framework 130, as well as at axially or longitudinally central portions thereof which in effect define a central station or position 135 of the plastic film roll supply magazine assembly 14. The central station or position 135 is aligned with the longitudinal axis of the frame member 20 so as to facilitate a new or fresh plastic film roll-spent or exhausted plastic film roll tube or core exchange operation which comprises the removal of a new or fresh plastic film roll 16 from the plastic film roll supply magazine assembly 14 by means of the exchange assembly 18, and the deposition of a spent or exhausted plastic film roll tube or core onto the plastic film roll supply magazine assembly 14 by means of the exchange assembly 18, as will be more fully described hereinafter.

As additionally seen or appreciated from FIGS. 1–3, the plastic film roll supply magazine assembly 14 further comprises a band cylinder assembly 136 which is similar to the band cylinder assembly 48 utilized upon the plastic film roll-spent film roll core or tube exchange assembly 18. Accordingly, it is appreciated that the band cylinder assembly 136 comprises a band cylinder component or housing 138 which is fixedly mounted atop one of the upper, longitudinally extending support beams 139 of the framework 130 and within which there is disposed a piston, not shown. A slide member 140, which is similar to the slide member 56 of the band cylinder assembly 48, is fixedly connected to the piston member, not shown, disposed internally within the band cylinder component or housing 138 and is adapted to be longitudinally movable along the band cylinder component or housing 138 in response to pneumatic driving air acting upon a particular side of the band cylinder piston, not shown, in a well-known manner. The slide member 140 has a substantially inverted U-shaped cross-sectional configuration and is provided with an upstanding pedestal portion 142 which is fixedly secured to a first lateral undersurface side portion of a magazine assembly platform 144 as may best be appreciated from FIG. 3. A plurality of wheels 146 are serially mounted in a longitudinal array along a second opposite lateral undersurface side portion of the magazine assembly platform 144 through means of a plurality of bracket members 148 such that the plurality of wheels 146 ride atop another upper, longitudinally extending support beam 150 of the framework 130 which is disposed opposite support beam 139. In this manner, the magazine assembly platform 144 is able to be moved along, and with respect to, the framework 130 in a balanced manner, and in particular with respect to the central station or position thereof 135, in a predeterminedly incremental manner so as to serially present or provide new or fresh plastic film rolls 16 to the central station or position 135 whereby the new or fresh plastic film roll-spent or exhausted plastic film roll core or tube exchange operation can be conducted as will be more fully discussed hereinafter.

Continuing further with reference still being made to FIGS. 1–3, it is additionally seen that a plurality of mounting plugs 152 are mounted upon the slidable magazine assembly platform 144 at predetermined longitudinally spaced locations thereof, the mounting plugs 152 being provided for mounting or supporting either the new or fresh plastic film rolls 16 upon the slidable platform 144 in preparation for an exchange operation whereby one of the new or fresh plastic film rolls 16 will be transferred to the plastic film roll dispenser mounting framework 12, or for mounting or supporting one of the spent or exhausted plastic film roll tubes or cores which has been transferred from the plastic film roll dispenser mounting framework 12 back to the plastic film roll supply magazine assembly 14. Apertures, not shown, are provided within the slidable platform 144, and each mounting plug 152 is provided with a dependent rod 153, best seen in FIG. 3, for disposition within the platform apertures such that each mounting plug 152 is retained within the slidable platform 144 at its predetermined location or position.

A first actuating piston-cylinder assembly 154 has its cylinder portion fixedly mounted upon a lower one of the longitudinally extending support beams 156 of the framework 130 by means of a suitable mounting bracket 158 such that the piston-cylinder assembly 154 is located at the central station or position 135 of the plastic film roll supply magazine assembly 14, and the piston rod, not shown, of the piston-cylinder assembly 154 is adapted to engage the dependent rod 153 of the mounting plug 152 located at the central station or position 135 when the piston rod is extended so as to elevate the mounting plug 152 in order to either properly position a new or fresh plastic film roll 16 mounted thereon in preparation for engagement by the grab mechanisms or pincers 71, 71 in conjunction with the performance of an exchange operation, or for receiving a tube or core from a spent or exhausted plastic film roll which is to be released by means of the grab mechanisms or pincers 70, 70.

It is further seen that a pair of upstanding rods 160, 160 are provided in conjunction with and adjacent to each mounting plug 152, and the rods 160, 160 are fixedly mounted upon the slidable platform 144. When new or fresh plastic film rolls 16 are mounted upon their respective mounting plugs 152, the beginning end or tail portion of the plastic film disposed upon the film roll 16 is initially grasped by means of an operator and spanned across the space 162 defined between the adjacent set or pair of rods 160, 160. The pole or rod 160 disposed most remote from its associated mounting plug 152 is provided with a suitable aperture or slot, not shown, through which the beginning end or tail portion of the plastic film is inserted. In this manner, the beginning end or tail portion of the plastic film is properly positioned so as to be readily grasped or engaged by means of the pivotal clamp member 94 movably disposed upon the new or fresh film roll/spent or exhausted tube or core exchange assembly 18. It is also noted that while three mounting plugs 152, 152, 152 have been illustrated as being mounted upon the slidable platform 144 and therefore defining three longitudinally separated positions or stations at which new or fresh plastic film rolls 16 can be mounted upon the platform 144, the precise or particular number of such mounting plugs 152 and stations defined thereby should not be so limited. Slidable platform 144 and supporting framework 130 can have any desirable longitudinal extent or length so as to effectively define or accommodate additional mounting stations or positions at which new or fresh plastic film rolls 16 can be disposed. In conjunction with such structure, it is also noted that while the band cylinder assembly 136 has the slide member 140 thereof operatively connected to its internally disposed piston, not shown, one or more auxiliary slide members 164, which may have external structure similar to that of the slide member 140 so as to enable such auxiliary slide members 164 to be guidably movable along the band cylinder housing 138, may be provided for slidably interconnecting the slidable platform 144 to the band cylinder housing 138 such that the slidable platform 144 is properly supported throughout its longitudinal extent or length upon the band cylinder housing 138. It is noted, however, that it is not necessary for the auxiliary slide members 164 to be operatively connected to the band cylinder assembly piston, not shown, because only one driving connection is required.

Lastly, the particular structure comprising the plastic film roll dispenser mounting framework 12 will now be described with particular reference being made to FIGS. 1–3 and 7–9. More particularly, the plastic film roll dispenser mounting framework 12 comprises a first, four-sided, vertically upstanding framework structure 166 which is defined by means of an upper fixed frame member 168, a lower frame member 170, and a pair of oppositely disposed side frame members 172, 174. The framework structure 166 is adapted to mount or support a plastic film roll 16 thereon such that the plastic film from the plastic film roll 16 can be unwound or dispensed during, for example, a palletized load plastic film wrapping operation. Accordingly, in order to properly mount or support the plastic film roll 16 upon the first framework structure 166, the upper fixed frame member 168 is provided with a downwardly dependent upper plug member 176 which is adapted to be removably disposed within the upper end portion of the film core or tube, while the lower frame member 170 is similarly provided with an upwardly extending lower plug member 178 which is disposed coaxially opposite the plug member 176. The upwardly extending lower plug member 178 is adapted to disengageably mount an insert 179 in a manner similar to the mounting plugs 152 disposed upon the magazine assembly 14 wherein the insert 179 is provided with the aforenoted flanged collar portion 80 and is adapted to be fixedly disposed within the lower end portion of the film core or tube. In this manner it can be readily appreciated that the plastic film roll 16 is able to be rotatably supported upon the plug member 176 and insert 179 during the plastic film dispensing or unwinding operation attendant the palletized load wrapping operation.

Obviously, means must be provided upon or incorporated within the framework structure 166 so as to enable the plug member 176 and insert 179 to in effect be inserted within and removed from the opposite ends of the plastic film roll core or tube during mounting and dismounting of the plastic film roll 16 onto and off of the framework structure 166 when, for example, a new or fresh plastic film roll 16 is to be mounted upon the framework structure 166, or alternatively, when the core or tube from a spent or exhausted plastic film roll is to be removed from the framework structure 166. Accordingly, it is further seen that the lower frame member 170 of the framework structure 166 actually comprises a fixed peripheral frame member 180 and a vertically movable frame member 182 which is disposed in effect within the periphery defined by means of the peripheral frame member 180 and upon which the lower upstanding plug member 178 is actually supported, fixed frame member 180 also having arcuate cut-out portions 183 defined within oppositely disposed side portions thereof so as to accommodate the vertical movements of the plug member 178. A pair of laterally spaced mounting blocks 184, 184 are affixed to opposite ends of the movable frame member 182, and a pair of upstanding guide rods 186, 186 have their lower end portions respectively affixed to the mounting blocks 184, 184. A pair of upper and lower guide brackets 188, 190 is provided for each one of the guide rods 186, 186 so as to guide the vertical movements of the guide rods 186, 186 when the lower movable frame member 182, lower plug member 178, and mounting blocks 184, 184 undergo their vertical movements in connection with the insertion or withdrawal of the lower plug member 178 into or out from the lower end of the insert 179 disposed within the lower end of the plastic film roll core or tube attendant the mounting of a fresh plastic film roll 16 upon the framework structure 166 or the removal of the core or tube of an exhausted plastic film roll.

Figure 7:
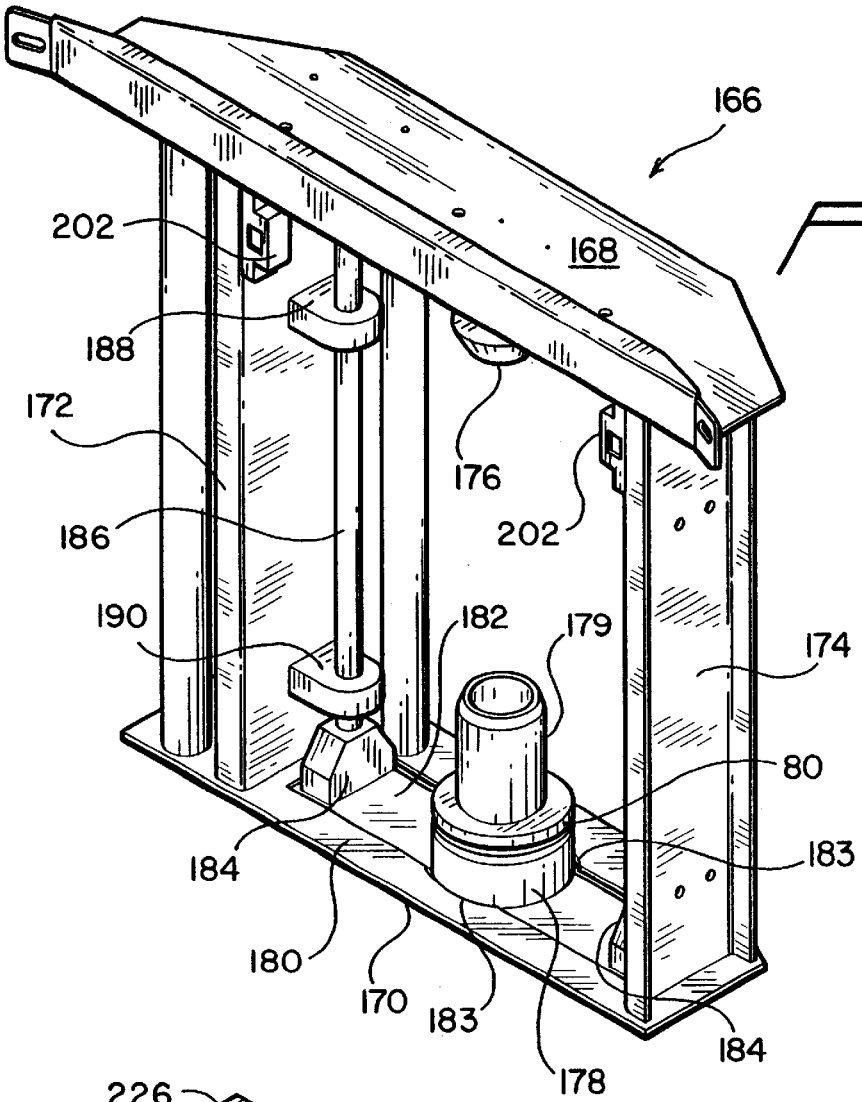
FIG. 7 is a perspective view of the plastic film roll dispenser mounting framework component of the new and improved automated plastic film roll exchange system as disclosed within FIG. 1.

In order to securely mount a new or fresh plastic film roll 16 upon the framework structure 166 of the plastic film roll dispenser mounting framework 12, the lower movable frame member 182 must be locked or latched in its upper position as illustrated, for example, in FIG. 7, and accordingly, the plastic film roll dispenser mounting framework 12 is provided with a suitable locking or latching system. More particularly, the plastic film roll dispenser mounting framework 12 further comprises a second vertically upstanding framework structure 192. As best seen from FIGS. 1 and 3, the second vertically upstanding framework structure 192 comprises a pair of laterally spaced vertically extending frame members 194, 194, and a horizontally or transversely extending upper frame member 196 which integrally interconnects the upper end portions of the vertical frame members 194, 194. A pair of laterally spaced, horizontally extending channel members 198, 198 are welded to the upper transversely extending frame member 196, and a pair of pneumatic piston-cylinder assemblies 200, 200 have their cylinder end portions fixedly mounted upon the undersurface portions of the channel members 198, 198 such that their respective piston rods, not shown, are disposed toward the first framework structure 166.

As may best be appreciated with reference again being made to FIGS. 7–9, a pair of latch mechanism mounting brackets 202, 202 are fixedly mounted upon upper interior surface portions of the oppositely disposed side frame members 172, 174 of the first framework structure 166 by means of suitable fasteners, not shown, which are adapted to be inserted through a pair of first through-bores 204, 204 which are respectively defined within upper and lower flanged portions 206, 208 of each mounting bracket 202. A second through bore 210, which is oriented 90° with respect to the first through-bores 204 and which has a substantially square-shaped cross-sectional configuration, is defined within a central portion 212 of each mounting bracket 202, and a pair of upper and lower blind bores 214, 216 are also defined within the central portion 212 of each mounting bracket 202 for respectively accommodating a pair of coil springs 218, 220.

Figure 9:
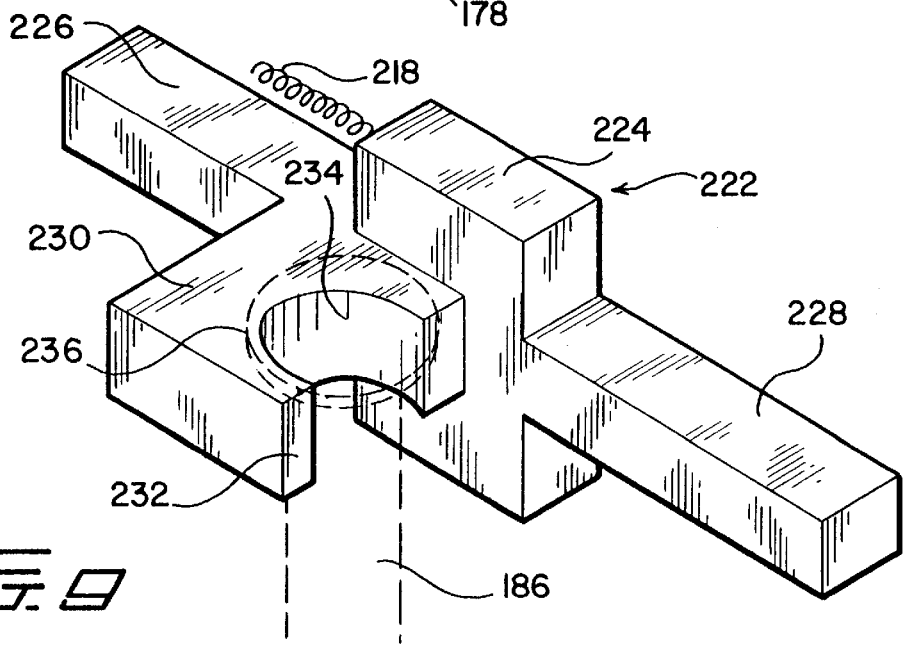
FIG. 9 is a perspective view of the latching mechanism employed in conjunction with the mounting bracket shown in FIG. 8.

A latch mechanism 222 is specifically disclosed within FIG. 9, and it is to be appreciated that one latch mechanism 222 is adapted to be operatively associated with each mounting bracket 202, 202. More particularly, it is seen that each latch mechanism 222 comprises a mounting block 224, a forwardly extending engagement bar 226 integrally fixed upon one end of the mounting block 224, and an activation bar 228 integrally fixed upon a second opposite end of the mounting block 224. The end of the mounting block 224 upon which engagement bar 226 is affixed is provided with upper and lower blind bores, not shown, within which the opposite ends of the springs 218, 220 are adapted to be accommodated, only spring 218 being shown in FIG. 9, and in this manner, the mounting block 224 of each latch mechanism 222 is normally biased away from its operatively associated mounting bracket 202, 202. The rearwardly extending activation bar 228 of each latch mechanism 222 is adapted to be disposed in engagement with the piston rod, not shown, of each piston-cylinder assembly 200 mounted upon the second framework structure 192, and accordingly, when the piston-cylinder assemblies 200, 200 are activated, the piston rods thereof act upon the activation bars 228, 228 of the latch mechanisms 222, 222 so as to move the mounting blocks 224, 224 of the latch mechanisms 222, 222 forwardly against the biasing forces of the coil springs 218, 220. A latch platform 23 is integrally mounted upon a side portion of each mounting block 224 such that each latch platform 230 can support the upper end of each guide rod 186 thereon.

More particularly, a side edge portion 232 of each latch platform 230 is provided with a through-bore 234 such that the resulting through-bore 234 as defined within the edge portion 232 of the latch platform 230 has a substantially semi-circular configuration which is open at the side edge portion 232 of the platform 230 so as to permit a shank portion of each guide rod 186 to in effect be laterally inserted therein or disengaged therefrom. The upper end portion of each guide rod 186 is also provided with an enlarged head or flanged portion 236, and accordingly, when the upper shank portion of each guide rod 186 is disposed within the through-bore 234 of the latch platform 230, and when the piston-cylinder assemblies 200, 200 are not activated, coil springs 218, 220 cause the latch mechanisms 222, 222 to move away from mounting brackets 202, 202 such that the enlarged head or flanged portion 236 of each guide rod 186 will be able to be seated upon and supported by the upper surface portion of each latch platform 230 thereby latching the lower movable frame member 182 at its locked position. In order to control the elevational or vertical movements of the lower movable frame member 182, lower plug member 178, and the pair of guide rods 186 through means of their mounting blocks 184, 184, an additional piston-cylinder assembly 238 is mounted upon a vertically disposed post or channel member 240, as best seen in FIGS. 1 and 3, such that the axis of the piston-cylinder assembly 238 is substantially co-axially disposed with respect to the vertical axis of the lower plug member 178. The piston rod 242 of the piston-cylinder assembly 238 has an annular or cup-shaped member 244 connected to the free end portion thereof for engaging the lower plug member 178 whereupon extension of the piston rod 242, cup-shaped member 244 can engage lower plug member 178 and thereby support the same during the elevational movements thereof attendant the removal of a core or tube portion of a spent or exhausted plastic film roll from the first framework structure 166 or the mounting of a new or fresh plastic film roll 16 upon the first framework structure 166.

Having now described all of the structural components comprising the new and improved automatic plastic film roll exchange system 10 constructed in accordance with the principles and teachings of the present invention, the automatic cyclical operation of the system 10 will now be described. It is to be initially noted that all of the operative or movable components of the system 10 are automatically controlled in accordance with well-known computer-controlled logic systems, which do not actually form a part of the present invention and therefore will not be discussed in any detail, and accordingly, all of the major or primary components of the system 10 are operatively connected to a central or common computer-controlled logic system or programmable logic control (PLC) 246 as schematically illustrated in FIG. 1. Accordingly, assuming that the supply of plastic film disposed upon a plastic film roll 16 which has been previously installed upon the first framework structure 166 has now become depleted or exhausted such that only the plastic film roll tube or core remains, it is desired to remove the tube or core of the depleted or exhausted plastic film roll disposed upon the first framework structure 166 and to replace the same by installing a new or fresh plastic film roll 16 upon the framework structure 166. The logic system 246 therefore controls the various electrical and pneumatic mechanisms, not shown, as a result of receiving a signal from a known type of end-of-supply or broken film sensor, not shown and not part of this invention, whereby, for example, the piston-cylinder assembly 42 is initially activated so as to linearly move the rack member 32 and thereby in turn cause rotation of the pinion member 36 whereby the longitudinal extent of the band cylinder assembly 48 and the primary slide member 66 are oriented substantially perpendicular to the longitudinal extent of the slidable magazine assembly platform 144. In accordance with this mode of operation, the grab mechanisms or pincers 70, 70 are therefore disposed toward or face the core or tube member of the depleted or exhausted plastic film roll disposed upon the framework structure 166, while the grab mechanisms or pincers 71, 71 are disposed toward or face a new or fresh plastic film roll 16 which is disposed upon the plug member 152 which is located at the central position or station 135 upon the slidable platform 144 of the plastic film roll supply magazine assembly 14. The depleted or exhausted plastic film roll core or tube and new or fresh plastic film roll 16 exchange operation is therefore now ready to commence.

Accordingly, the first step in the cyclical operation is to enable the core or tube from the depleted or exhausted plastic film roll to be released from its mounted dispensing position upon the framework structure 166 of the dispenser mounting framework 12. This release operation is achieved, in effect, in a two-step manner so as to initially release the upper end of the core or tube from the upper plug member 176, and to then in effect release the lower plug member 178 from the insert 179 disposed within the lower end of the plastic film tube or core. Therefore, the piston 242 of the piston-cylinder assembly 238 is at this time raised such that the cup-shaped member 244 thereof can be partially inserted within the underside portion of the plug member 178 disposed upon the lower movable frame member 182. Piston-cylinder assemblies 200, 200 are then actuated so as to in turn actuate the latch mechanisms 222, 222 whereby the latch mechanisms 222, 222 are moved against the biasing forces of springs 218, 220 so as to release the guide rods 186, 186. Movable frame member 182 is therefore now able to move downwardly a first predetermined amount until the plug member 178 is seated and supported upon the cup-shaped member 244 of the piston-cylinder assembly 238 whereby the upper end of the core or tube has been released from the upper plug member 176 and the flange portion 80 at the lower end of the insert 179 disposed within the film roll core or tube is disposed at a predetermined elevation.

The band cylinder assembly 48 is then actuated so as to initially advance the primary slide plate 66 toward the depleted or exhausted plastic film roll core or tube disposed upon the framework structure 166, and when the grab mechanisms or pincers 70, 70 are positioned around the flange portion 80 of the insert 179 disposed within the lower end portion of the depleted or exhausted plastic film roll core or tube, the piston-cylinder assembly 74 is actuated such that the grab mechanisms or pincers 70, 70 are moved to their relatively closed positions so as to tightly engage the flange portion 80 of the insert 179, disposed within the lower end portion of the depleted or exhausted plastic film roll core or tube, and thereby support the same. The piston rod 242 of the piston-cylinder assembly 238 can now be lowered a predetermined amount whereby the movable frame member 182, and the lower plug member 178 disposed thereon, are able to be sufficiently lowered a second predetermined amount such that the lower plug member 178 is able to be released or removed from the insert 179 disposed within the lower end portion of the core or tube.

Subsequently, with the depleted or exhausted plastic film roll core or tube now supported upon the exchange assembly 18 by means of the grab mechanisms or pincers 70, 70, the band cylinder assembly 48 is again actuated so as to linearly or translationally move the primary slide plate 66 toward the plastic film roll supply magazine assembly 14. At this time, the piston-cylinder assembly 154 is actuated so as to elevate the plug member 152, which is disposed at the central station or position 135 and upon which a new or fresh plastic film supply roll 16 is mounted and supported, a predetermined amount so as to facilitate the removal of the new or fresh plastic film supply roll 16 from the supply magazine assembly 14 by means of the grab mechanisms or pincers 71, 71. Accordingly, as a result of the linear or translational movement of the primary slide plate 66 by means of the band cylinder assembly 48, the grab mechanisms or pincers 71, 71 are disposed so as to encircle the flange portion 80 of the insert 179 disposed within a new or fresh plastic film roll tube or core, and as a result of the actuation of the piston-cylinder assembly 75, the grab mechanisms or pincers 71, 71 are moved to their closed positions so as to in fact tightly engage the flange portion 80 of the insert 179 disposed within the new or fresh plastic film roll tube or core. Subsequently, the piston-cylinder assembly 154 is actuated so as to permit the central station plug member 152 to be lowered and again seated and supported upon the supply magazine slidable platform 144.

As a result of the aforenoted lowered movement of the central plug member 152, the same is now of course disengaged from the tube or core of the new or fresh plastic film roll 16 and therefore permits the exchange assembly 18 to actually remove the new or fresh plastic film roll 16 from the supply magazine assembly 14. At the same time, piston-cylinder assembly 96 is actuated such that the piston rod 98 thereof is extended whereby clamp member 94 is moved from its horizontal position to its vertical position whereby the beginning or tail end of the new or fresh plastic film roll 16 is grasped by means of the clamp member 94 and subsequently clamped between the clamp members 92, 94. Accordingly, the band cylinder assembly 48 is again actuated so as to move the primary slide plate 66 to a substantially intermediate or central position defined between the framework structure 166 and the supply magazine assembly 14. At this point in time, the piston-cylinder assembly 42 is actuated so as to actuate the rack member 32 which in turn causes the pinion member 36, the rotary shaft 37, and the band cylinder assembly 48 to undergo rotational movement of 180°. It is therefore appreciated that the new or fresh plastic film roll 16 which was removed from the new or fresh plastic film roll supply magazine assembly 14 is now disposed adjacent to the plastic film roll dispenser mounting framework 12 while the core or tube of the depleted or exhausted plastic film roll which was removed from the framework structure 166 is now disposed adjacent to the magazine assembly 14. In order to complete the entire exchange operation, it now remains to mount the new or fresh plastic film roll 16 upon the framework structure 166 while the core or tube of the depleted or exhausted plastic film roll is likewise mounted upon the magazine assembly 14.

Accordingly, band cylinder assembly 48 is again actuated so as to linearly translate the primary slide plate 66 such that the new or fresh plastic film roll 16 now being held and supported by means of the pincers 71, 71 is coaxially disposed above the plug member 178 of the framework structure 166. Piston-cylinder assembly 238 is then actuated a first predetermined amount so as to elevate plug member 178, movable frame member 182, mounting blocks 184, 184, and guide rods 186, 186 until lower plug member 178 is seated within the lower end portion of the insert 179 disposed within the lower end portion of the tube or core of the new or fresh plastic film roll 16 whereby the new or fresh plastic film roll 16 is now supported upon the lower plug member 178. Piston-cylinder assembly 75 is then actuated so as to actuate the grab mechanisms or pincers 71, 71 to their relatively opened positions whereby the grab mechanisms or pincers 71, 71 are released from the flange portion 80 of the insert 179 disposed within the new or fresh plastic film roll 16. The band cylinder assembly 48 is then again actuated so as to retract the primary slide plate 66 away from the framework structure 166 whereupon the piston-cylinder assembly 238 can be actuated a second predetermined amount so as to elevate the lower plug member 178 and the movable frame member 182 to their substantially uppermost positions such that the upper plug member 176 is now able to be disposed within the upper end portion of the tube or core of the new or fresh plastic film roll 16. Piston-cylinder assemblies 200, 200 are also at this time actuated so as to permit the coil springs 218, 220 to return the latch mechanisms 222, 222 to their normal positions whereby the flanged portions 236, 236 of the guide rods 186, 186 can again be supported upon the latch platforms 230, 230 so as to retain the lower movable frame member 182 in its upper or raised latched or locked position.

Subsequently, the band cylinder assembly 48 is actuated so as to linearly translate the primary slide plate 66 toward the supply roll magazine assembly 14 whereby the core or tube from the depleted or exhausted plastic film roll is now coaxially disposed above the plug member 152 disposed at the central position or station 135 of the magazine assembly 14. Piston-cylinder assembly 154 is then actuated so as to again raise or elevate the plug member 152 disposed at the central position or station 135 whereby the central position or station plug member 152 is seated within the lower end portion of the insert 179 disposed within the lower end portion of the depleted or exhausted film roll core or tube so as to support the same. Piston-cylinder assembly 74 is then actuated so as to move the grab mechanisms or pincers 70, 70 to their relatively opened positions whereby the grab mechanisms or pincers 70, 70 are released from the flanged portion 80 of the insert 179 disposed within the depleted or exhausted plastic film roll. The piston-cylinder assembly 154 is then actuated so as to lower the plug member 152 disposed at the central position or station 135 such that the plug member 152, and the core or tube of the depleted or exhausted plastic film roll supported thereon, are effectively seated and supported upon the magazine assembly platform 144. Continuing the operation, band cylinder assembly 48 is again actuated so as to linearly move the primary slide plate 66 back towards its central position between the framework structure 166 and the magazine assembly 14, and piston-cylinder assembly 42 is again actuated so as to actuate the pinion member 36 and rotary shaft 37 whereby the band cylinder assembly 48 is again rotated through means of a 180° movement in the reverse direction such that the grab mechanisms or pincers 70, 70 are again disposed toward the framework structure 166 while the grab mechanisms or pincers 71, 71 are again disposed toward the magazine assembly 14. Lastly, band cylinder assembly 136 is actuated so as to linearly move the magazine assembly platform 144 a predetermined or incremental amount such that a new or fresh plastic film roll 16 is now disposed at the central position or station 135. All components of the apparatus or system 10 of the present invention are now disposed in readied positions for the commencement of a new exchange operation when the plastic film supply disposed upon the framework structure 166 is depleted or exhausted.

Thus, it may be seen that in accordance with the principles and teachings of the present invention, a new and improved new or fresh plastic film roll/deplete or exhausted plastic film roll tube or core exchange system has been developed wherein a supply of new or fresh plastic film rolls are serially mounted upon a new or fresh plastic film roll supply magazine, and a new or fresh plastic film roll/spent or exhausted plastic film roll core or tube exchange mechanism is utilized to remove a spent or exhausted plastic film roll core or tube from a plastic film roll dispenser mounting framework, remove a new or fresh plastic film roll from the supply magazine, and mount the new or fresh plastic film roll upon the plastic film roll dispenser mounting framework while the spent or exhausted plastic film roll core or tube is mounted upon the supply magazine.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An automatic fresh material supply roll and exhausted material roll core exchange system, comprising:

a dispenser mounting framework upon which a material supply roll is mounted such that a supply of material disposed upon the material supply roll can be dispensed until the supply of material disposed upon the material supply roll is exhausted whereupon only an exhausted material roll core remains disposed upon said dispenser mounting framework;

a magazine assembly upon which a plurality of fresh material supply rolls are disposed in preparation for the individual transfer of one of the plurality of fresh material supply rolls to said dispenser mounting framework when the material supply roll disposed upon said dispenser mounting framework is exhausted; and an exchange assembly operatively movable between said dispenser mounting framework and said magazine assembly for removing the exhausted material roll core from said dispenser mounting framework, for removing one of the plurality of fresh material supply rolls from said magazine assembly, and for exchanging the one of the plurality of fresh material supply rolls removed from said magazine assembly with the exhausted material roll core removed from said dispenser mounting framework by depositing the one of the plurality of fresh material supply rolls removed from said magazine assembly upon said dispenser mounting framework and by depositing the exhausted material roll core removed from said dispenser mounting framework upon said magazine assembly.

2. The system as set forth in claim 1, further comprising:

a plurality of mounting plugs disposed within a longitudinal array upon said magazine assembly for mounting the plurality of fresh material supply rolls thereon; and an exchange station is defined at a predetermined longitudinal position of said magazine assembly at which a leading one of the plurality of fresh material supply rolls disposed within the longitudinal array is removed from its mounting plug and upon which the exhausted material roll core is deposited.

3. The system as set forth in claim 2, wherein said magazine assembly further comprises:

a platform upon which said plurality of mounting plugs are disposed; and means for incrementally moving said platform upon said magazine assembly so as to serially present individual ones of said mounting plugs, and individual ones of the plurality of fresh material supply rolls respectively mounted upon said plurality of mounting plugs, to said exchange station such that the leading one of the plurality of fresh material supply rolls can be removed from said magazine assembly platform in exchange for an exhausted material roll core mounted upon said dispenser mounting framework.

4. The system as set forth in claim 3, wherein:

said means for incrementally moving said platform upon said magazine assembly comprises a first band cylinder assembly operatively connected to said platform.

5. The system as set forth in claim 3, further comprising:

a fourth piston-cylinder assembly for vertically moving the plug member, mounted upon said magazine assembly platform and disposed at said exchange station, between raised and lowered positions so as to enable removal of the leading one of the fresh material supply rolls from said magazine assembly and the deposition of the exhausted material roll core onto said magazine assembly.

6. The system as set forth in claim 1, wherein:

said dispenser mounting framework and said magazine assembly are spaced apart from each other;

said exchange assembly is interposed between said dispenser mounting framework and said magazine assembly; and said exchange assembly comprises a first mechanism for undergoing rotational movements between said dispenser mounting framework and said magazine assembly, and a second mechanism for undergoing longitudinal linear movements between said dispenser mounting framework and said magazine assembly, wherein both of said longitudinal linear and rotational movements are required for achieving the exchange of the one of the plurality of fresh material supply rolls removed from said magazine assembly with the exhausted material roll core removed from said dispenser mounting framework.

7. The system as set forth in claim 6, wherein:

said exchange assembly comprises a framework;

said first mechanism for undergoing said rotational movements between said magazine assembly and said dispenser mounting framework comprises a rack member mounted upon said exchange assembly framework, and a pinion member operatively engaged with said rack member; and said second mechanism for undergoing said longitudinal linear movements comprises a second band cylinder assembly operatively connected to said pinion member, and a slide plate operatively connected to said second band cylinder assembly such that when said rack and pinion members are actuated, said second band cylinder assembly and said slide plate can undergo rotational movements with respect to said dispenser mounting framework and said magazine assembly, and when said second band cylinder assembly is actuated, said slide plate can undergo longitudinal linear movements with respect to said dispenser mounting framework and said magazine assembly.

8. The system as set forth in claim 7, further comprising:

a first piston-cylinder assembly mounted upon said exchange assembly framework and operatively connected to said rack member for moving said rack member so as to in turn cause rotational movement of said pinion member.

9. The system as set forth in claim 7, further comprising:

a set of grab mechanism pincers respectively mounted upon opposite end portions of said exchange assembly slide plate for respectively grasping the exhausted material roll core disposed upon said dispenser mounting framework, and a core portion of the one of the plurality of fresh material supply rolls disposed upon said magazine assembly, so as to achieve the exchange of the one of the plurality of fresh material supply rolls removed from said magazine assembly with the exhausted material roll core removed from said dispenser mounting framework.

10. The system as set forth in claim 9, wherein:

each one of said sets of pincers comprises a pair of pincers, a pair of enmeshed gears upon which one of said pair of pincers is respectively mounted, and a second piston-cylinder assembly operatively connected to one of said pair of gears for rotating said gears in opposite directions so as to cause said pair of pincers to be moved with respect to each other between relatively opened and relatively closed positions.

11. The system as set forth in claim 7, wherein:

said magazine assembly comprises a platform upon which a plurality of mounting plugs are disposed for respectively mounting the plurality of fresh material supply rolls thereon, and at least one upstanding rod respectively disposed adjacent each one of said plurality of mounting plugs for receiving a beginning tail end portion of the material disposed upon each one of the plurality of fresh material supply rolls; and said exchange assembly slide plate comprises a clamping mechanism for grabbing the tail end portion of the material disposed upon each one of the plurality of fresh material supply rolls when the one of the plurality of fresh material supply rolls is removed from said magazine assembly.

12. The system as set forth in claim 1, wherein said dispenser mounting framework comprises:

a first upper fixed frame member;

a second lower frame member movable between a first latched position and a second unlatched position;

first and second upper and lower coaxially disposed plug members respectively mounted upon said first upper fixed and second lower movable frame members for disposition within opposite ends of a core of a material supply roll; and a latching mechanism for releasably latching said second lower movable frame member with respect to said first upper fixed frame member so as to permit said second lower plug member to be moved with respect to said first upper plug member from said first latched position, at which said first and second plug members can be fixedly disposed within opposite ends of a core of a material supply roll whereby a core of a material supply roll is fixedly mounted upon said dispenser mounting framework, to said second unlatched position at which said first and second plug members are removed from the opposite ends of a core of a material supply roll whereby the exhausted material roll core can be removed from said dispenser mounting framework and one of the plurality of fresh material supply rolls can be mounted upon said dispenser mounting framework.

13. The system as set forth in claim 12, further comprising:

a third piston-cylinder assembly for vertically moving said second lower movable frame member, and said second lower plug member mounted thereon, back toward said latched position such that said first upper and second lower plug members can retain a fresh material supply roll upon said dispenser mounting framework.

14. The system as set forth in claim 12, further comprising:

a fifth piston-cylinder assembly for operating said latching mechanism.

15. The system as set forth in claim 1, further comprising:

a programmable logic control (PLC) system operatively connected to said dispenser mounting framework, said magazine assembly, and said exchange assembly for automatically controlling all movable components comprising said dispenser mounting framework, said magazine assembly, and said exchange assembly.

16. A method of exchanging a fresh material supply roll for an exhausted material roll core, comprising the steps of:

providing a dispenser mounting framework upon which a material supply roll is initially mounted such that a supply of material disposed upon the material supply roll can be dispensed until the supply of material disposed upon the material supply roll is exhausted whereupon only an exhausted material roll core remains disposed upon said dispenser mounting framework;

providing a magazine assembly upon which a plurality of fresh material supply rolls are disposed in preparation for the individual transfer of one of the plurality of fresh material supply rolls to said dispenser mounting framework when the material supply roll disposed upon said dispenser mounting framework is exhausted; and moving an exchange assembly between said dispenser mounting framework and said magazine assembly so as to exchange one of the plurality of fresh material supply rolls disposed upon said magazine assembly for an exhausted material roll core disposed upon said dispenser mounting framework by removing the exhausted material roll core from said dispenser mounting framework, removing one of the plurality of fresh material supply rolls from said magazine assembly, depositing the one of the plurality of fresh material supply rolls removed from said magazine assembly upon said dispenser mounting framework, and depositing the exhausted material roll core removed from said dispenser mounting framework upon said magazine assembly.

17. The method as set forth in claim 16, wherein said step of exchanging the one of the plurality of fresh material supply rolls removed from said magazine assembly for the exhausted material roll core removed from said dispenser mounting framework comprises the steps of:

linearly moving an exchange assembly in a first longitudinal direction toward said dispenser mounting framework and grabbing the exhausted material roll core;

linearly moving said exchange assembly in a second opposite longitudinal direction away from said dispenser mounting framework and toward said magazine assembly so as to remove the grabbed exhausted material roll core from said dispenser mounting framework, and grabbing one of the plurality of fresh material supply rolls disposed upon said magazine assembly;

linearly moving said exchange assembly in said first longitudinal direction away from said magazine assembly and toward said dispenser mounting framework so as to remove the one of the plurality of fresh material supply rolls from said magazine assembly;

rotating said exchange assembly 180° such that the one of the plurality of fresh material supply rolls is now disposed adjacent to said dispenser mounting framework and the exhausted material roll core is now disposed adjacent to said magazine assembly;

linearly moving said exchange assembly in said first longitudinal direction so as to deposit the one of the plurality of fresh material supply rolls onto said dispenser mounting framework; and linearly moving said exchange assembly in said second opposite longitudinal direction so as to deposit the exhausted material roll core upon said magazine assembly.

18. The method as set forth in claim 17, further comprising the steps of:

providing a first upper fixed frame member upon said dispenser mounting framework;

providing a second lower frame member upon said dispenser mounting framework which is vertically movable with respect to said first upper fixed frame member;

providing first and second upper and lower coaxially disposed plug members respectively mounted upon said first upper fixed and second lower movable frame members for disposition within opposite ends of a core of a material supply roll; and vertically moving said second lower frame member with respect to said first upper fixed frame member in a two-step mode wherein said second lower frame member is moved downwardly a first predetermined amount so as to release a first upper end of the exhausted material roll core to be disengaged from said first upper plug member and to permit said exchange mechanism to grab the exhausted material roll core, and wherein further, said second lower frame member is moved downwardly a second predetermined amount so as to remove said second lower plug member from a second lower end of the exhausted material roll core.

19. The method as set forth in claim 17, further comprising the step of:

operatively connecting a programmable logic control (PLC) system to said dispenser mounting framework, said magazine assembly, and said exchange assembly for automatically controlling all movable components comprising said dispenser mounting framework, said magazine assembly, and said exchange assembly.

20. The method as set forth in claim 16, further comprising the steps of:

providing a platform upon said magazine assembly;

providing a plurality of mounting plugs within a longitudinal array upon said platform for mounting the plurality of fresh material supply rolls thereon;

defining an exchange station at a predetermined longitudinal position of said magazine assembly at which a leading one of the plurality of fresh material supply rolls disposed within the longitudinal array of fresh material supply rolls is removed from its mounting plug and upon which the exhausted material roll core is to be deposited; and incrementally moving said platform upon said magazine assembly so as to serially present individual ones of said mounting plugs, and individual ones of the plurality of fresh material supply rolls respectively mounted upon said plurality of mounting plugs, to said exchange station such that the leading one of the plurality of fresh material supply rolls can be removed from said magazine assembly platform in exchange for an exhausted material roll core mounted upon said dispenser mounting framework.

* * * * *